US011698223B2

(12) United States Patent
Kulkarni et al.

(10) Patent No.: US 11,698,223 B2
(45) Date of Patent: Jul. 11, 2023

(54) SYSTEM AND METHOD FOR TEMPERATURE CONTROL OF REFRIGERATOR WITH CONVERTIBLE COMPARTMENT

(71) Applicant: WHIRLPOOL CORPORATION, Benton Harbor, MI (US)

(72) Inventors: Rishikesh Vinayak Kulkarni, St. Joseph, MI (US); Mahendra Patil, Maharashtra (IN); E. C. Pickles, St. Joseph, MI (US); Daniel N. Maas, Loureira (PT); Murthy Raju V.S.N. Jaina, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 347 days.

(21) Appl. No.: 16/747,657

(22) Filed: Jan. 21, 2020

(65) Prior Publication Data

US 2021/0222946 A1 Jul. 22, 2021

(51) Int. Cl.
*F25D 29/00* (2006.01)
*F25D 11/02* (2006.01)
(Continued)

(52) U.S. Cl.
CPC ..... *F25D 29/003* (2013.01); *F25D 11/02* (2013.01); *F25D 17/065* (2013.01);
(Continued)

(58) Field of Classification Search
CPC ..... F25D 29/003; F25D 11/02; F25D 11/022; F25D 13/04; F25D 17/065; F25D 17/067;
(Continued)

(56) References Cited

U.S. PATENT DOCUMENTS 3,135,316 A * 6/1964 Foster ..... F25D 21/08 165/267
6,725,678 B2 4/2004 Chang et al.
(Continued)

FOREIGN PATENT DOCUMENTS

CN 1752680 A 3/2006
EP 1806553 A1 7/2007
(Continued)

*Primary Examiner* — Cassey D Bauer
(74) *Attorney, Agent, or Firm* — Price Heneveld LLP

(57) ABSTRACT

A method for controlling an operation of a refrigeration appliance includes controlling a first cooling routine for a first compartment via a flow of a thermal exchange media to a first evaporator. The method further includes controlling a heating routine in response to a setpoint temperature being greater than the temperature of the first compartment. The heating routine includes activating a heating element and a fan in the first compartment over a first interval and deactivating the heating element and the fan over a second interval. The heating routine continues by activating the first interval and the second interval over alternating time periods. In response to the temperature of the first compartment being greater than or equal to a target temperature associated with the setpoint, the method may control the operation of the appliance by returning to the cooling routine.

20 Claims, 4 Drawing Sheets

(51) Int. Cl.
*F25D 17/06* (2006.01)
*F25D 21/04* (2006.01)
*F25D 31/00* (2006.01)

(52) U.S. Cl.
CPC ..... *F25D 17/067* (2013.01); *F25D 21/04* (2013.01); *F25D 31/005* (2013.01); *F25D 2400/02* (2013.01); *F25D 2700/121* (2013.01); *F25D 2700/122* (2013.01)

(58) Field of Classification Search
CPC ..... F25D 21/04; F25D 23/12; F25D 31/005; F25D 2317/06; F25D 2400/02; F25D 2600/06; F25D 2700/121; F25D 2700/122
See application file for complete search history.

(56) References Cited

U.S. PATENT DOCUMENTS

| | | | | |
|---|---|---|---|---|
| 7,051,539 | B2 * | 5/2006 | Junge | F25D 17/045 62/187 |
| 8,074,469 | B2 * | 12/2011 | Hamel | F25D 11/022 62/441 |
| 10,465,967 | B2 | 11/2019 | Besore et al. | |
| 10,514,194 | B2 | 12/2019 | Avhale et al. | |
| 2010/0199709 | A1 * | 8/2010 | Holland | F25D 11/02 62/447 |
| 2018/0347885 | A1 * | 12/2018 | Avhale | F25B 5/04 |

FOREIGN PATENT DOCUMENTS

| | | | | |
|---|---|---|---|---|
| EP | 3018436 | B1 * | 3/2019 | F25D 21/08 |
| JP | H05215460 | A | 8/1993 | |
| WO | 2015129315 | A1 | 9/2015 | |

* cited by examiner

SYSTEM AND METHOD FOR TEMPERATURE CONTROL OF REFRIGERATOR WITH CONVERTIBLE COMPARTMENT

FIELD OF THE DEVICE

The device is in the field of refrigerating appliances, and more specifically, a refrigerating appliance having a convertible compartment configured to rapidly change in temperature.

SUMMARY

In at least one aspect, a refrigerating appliance is disclosed. The appliance comprises a plurality of storage compartments comprising a first compartment comprising a first evaporator configured to absorb heat energy. A first heating element is disposed in a first compartment. A temperature sensor also disposed in the first compartment and configured to identify a temperature signal. A controller is configured to control a cooling routine for the first compartment. To control the cooling routine, the controller controls a flow of a thermal exchange media to the first evaporator. The controller is further configured to receive an indication of a temperature setting comprising a setpoint and identify a temperature of the first compartment in response to the temperature signal from the temperature sensor. The controller is further configured to control a heating routine in response to the setpoint being greater than the temperature of the first compartment. The heating routine comprises a first interval wherein the controller is configured to activate the first heating element and a second interval wherein the controller is configured to deactivate the first heating element. The controller is configured to activate the first interval and the second interval over alternating time periods until the temperature of the first compartment is greater than or equal to a target temperature associated with the setpoint.

In another aspect, a method for controlling an operation of a refrigeration appliance is disclosed. The method comprises controlling a first cooling routine for a first compartment via a flow of a thermal exchange media to a first evaporator. The method further comprises controlling a heating routine in response to a setpoint temperature being greater than the temperature of the first compartment. The heating routine comprises activating a heating element and a fan in the first compartment over a first interval and deactivating the heating element and the fan over a second interval. The heating routine continues by activating the first interval and the second interval over alternating time periods. In response to the temperature of the first compartment being greater than or equal to a target temperature associated with the setpoint, the method may control the operation of the appliance by returning to the cooling routine.

In yet another aspect, a refrigerating appliance is disclosed. The appliance comprises a plurality of storage compartments comprising a convertible compartment comprising a first heating element, a first evaporator, and a first fan disposed therein. The plurality of compartments further comprises a freezer compartment adjacent to the convertible compartment. The freezer compartment comprises a second heating element, a second evaporator, and a second fan disposed therein. At least one temperature sensor is disposed in the convertible compartment and configured to identify a temperature signal. A controller is configured to control a cooling routine for the first compartment and the second compartment. The controller selectively controls a flow of a thermal exchange media to the first evaporator and the second evaporator to process the cooling routines. The controller is further configured to receive an indication of a temperature setting comprising a setpoint of the convertible compartment and identify a temperature of the convertible compartment in response to the temperature signal from the temperature sensor.

The controller is further configured to control a heating routine in response to the setpoint being greater than the temperature of the convertible compartment. The heating routine comprises a first interval wherein the controller is configured to activate the first heating element and the first fan and a second interval wherein the controller is configured to deactivate the first heating element and the first fan. The controller is configured to activate the first interval and the second interval over alternating time periods until the temperature of the convertible compartment is greater than or equal to a target temperature associated with the setpoint.

These and other features, advantages, and objects of the present device will be further understood and appreciated by those skilled in the art upon studying the following specification, claims, and appended drawings.

DETAILED DESCRIPTION OF EMBODIMENTS

Figure 1:
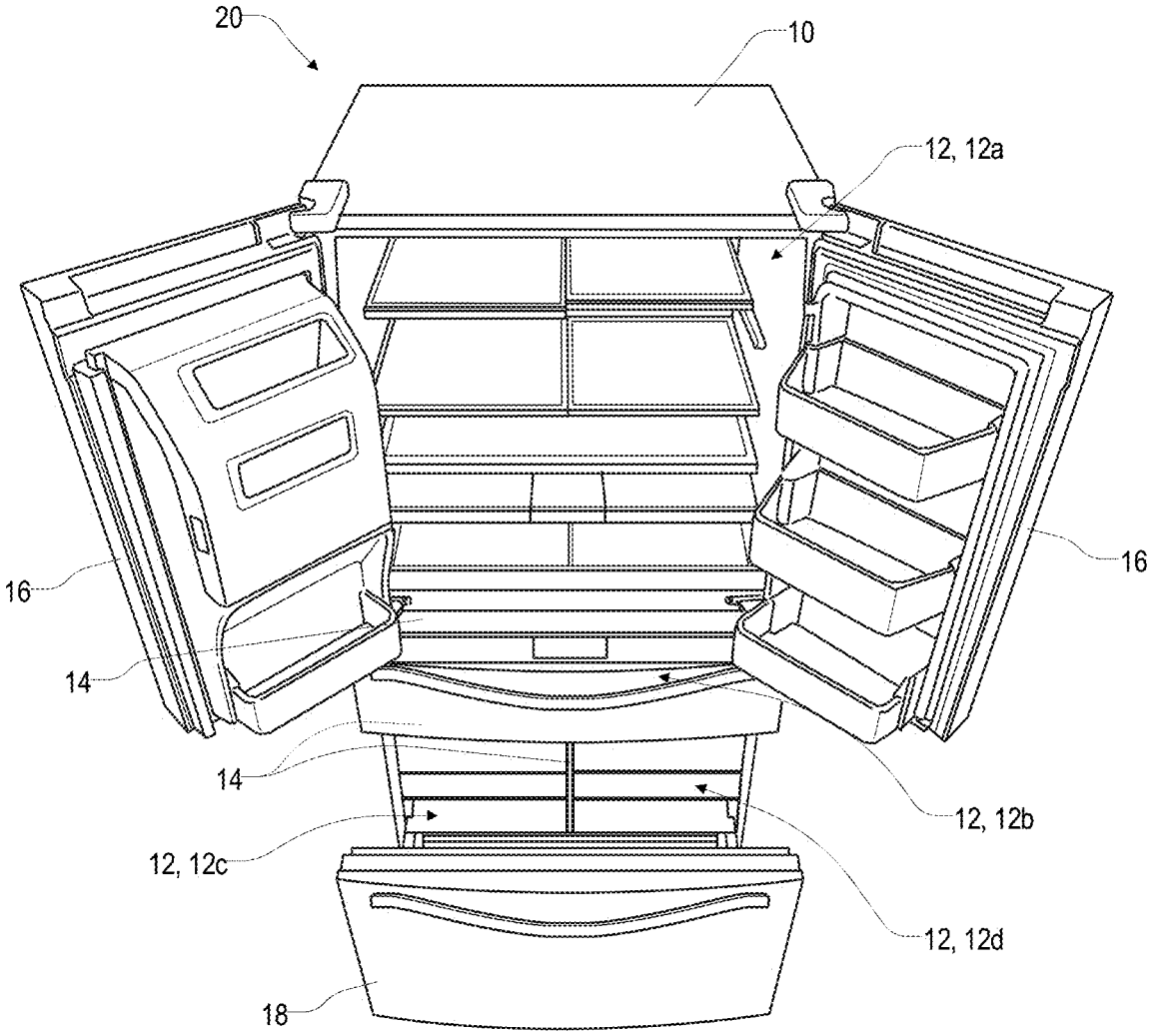
FIG. 1 is a front perspective view of a refrigerating appliance having a plurality of operable panels each shown in the open position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
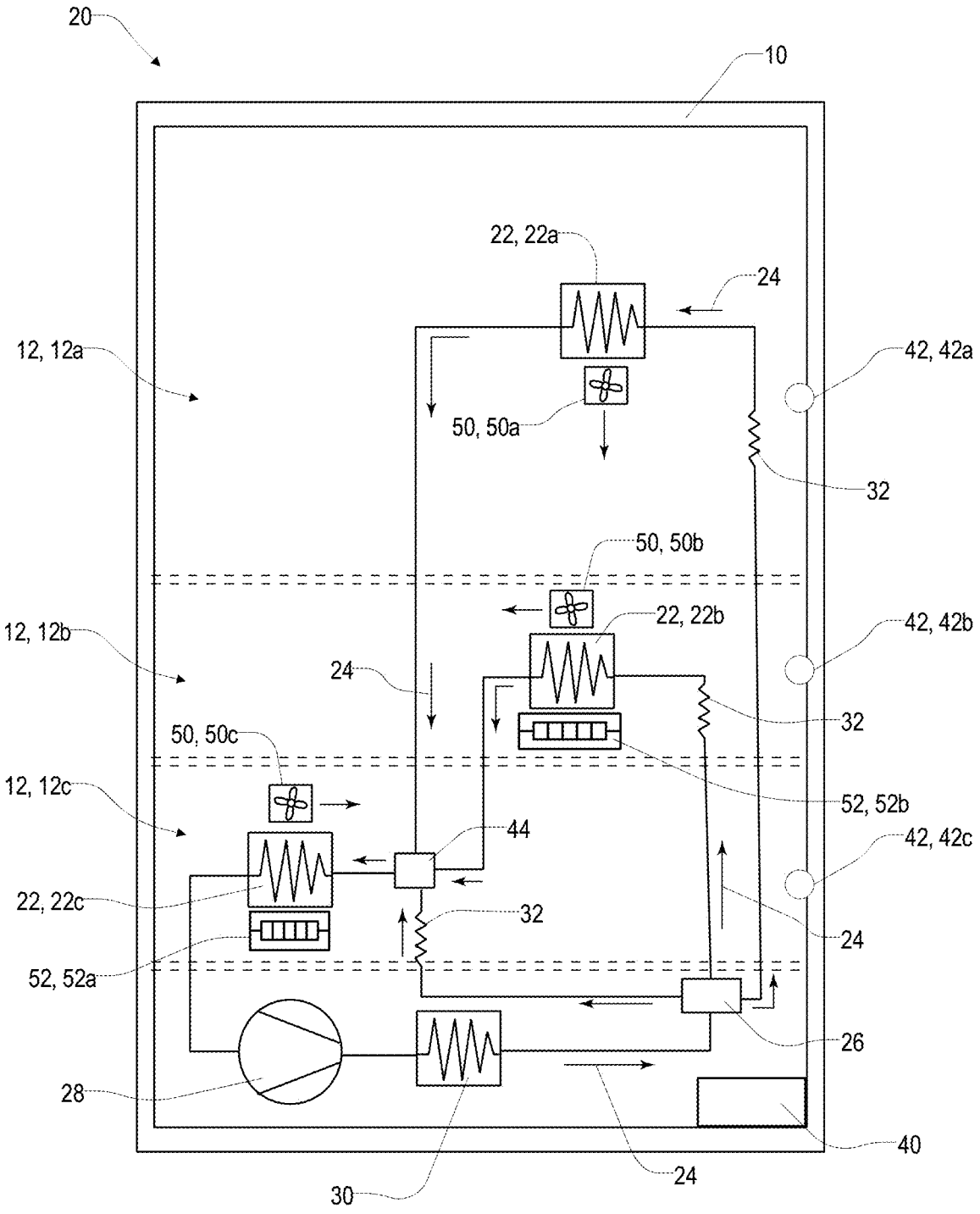
FIG. 2 is a schematic diagram illustrating an appliance having an aspect of the multi-evaporator refrigeration system.

Referring generally to FIGS. 1 and 2, a system for controlling a temperature of a refrigeration appliance 10 is disclosed. Though discussed in reference to specific examples, the refrigeration appliance 10 may correspond to any form of refrigerator that may be utilized at various predetermined temperatures that may be changed over time to support flexible usage or storage needs. As demonstrated in FIG. 1, the refrigeration appliance 10 may comprise a plurality of storage compartments 12. The storage compartments 12 may include a refrigerator compartment 12*a*, a convertible storage compartment 12*b*, and a freezer compartment 12*c*. As depicted, the convertible compartment 12*b* is disposed between the refrigerator compartment 12*a* and the freezer compartment 12*c*, but the compartments 12 may be arranged in a variety of topographies or arrangements without departing from the spirit of the disclosure. Each of the compartments 12 may be divided by a mullion or divider 14 configured to insulate the compartments 12 for independent temperature control. Additionally, one or more of the compartments 12 may be controlled to adjust in temperature such that the compartments 12 may be implemented to store frozen or fresh items.

Though the convertible compartment 12*b* is depicted in FIG. 1 as being positioned between the refrigerator compartment 12*a* and the freezer compartment 12*c*, a convertible compartment may be implemented in a variety of configurations. For example, in some instances, a convertible compartment 12*d* may be arranged as a portion of the freezer compartment 12 and may be separated or divided by one of the mullions 14 or dividers to bisect the freezer compartment 12*c* or divide it into various proportions. In general, each of the compartments 12*a*-12*d* may be accessible via one or more doors 16 or drawers 18. For example, each of the compartments may share or have independent doors 16 or drawers 18 and may be divided by seals that may interact with the mullions 14 to insulate the compartments 12 from each other. Accordingly, the refrigeration appliance 10 may be flexibly implemented in a variety of configurations without departing from the spirit of the disclosure.

As depicted in FIG. 2, a schematic diagram of a refrigeration control system 20 is shown in relation to each of the storage compartments 12. As depicted, each of the compartments 12 may comprise an evaporator 22. The evaporators 22 may include a refrigerator evaporator 22*a*, a convertible compartment evaporator 22*b*, and a freezer evaporator 22*c*. Each of the evaporators 22 be selectively supplied with a thermal exchange media 24 from a multi-directional outlet valve 26. As shown, the multi-directional outlet valve 26 corresponds to a 4-way valve configured to selectively supply the thermal exchange media 24 to each of the evaporators 22. A flow path of the thermal exchange media 24 through the system 20 is demonstrated by the arrows shown in FIG. 2. The thermal exchange media 24 is supplied to the multi-directional outlet valve 26 from a compressor 28 via a condenser 30. From the multi-directional outlet valve 26, the thermal exchange media 24 is supplied to each of the evaporators 22 via an expansion device 32. In this configuration, the thermal exchange media 24 may circulate through the system 20

In order to control the operation of the system 20, a controller 40 may be incorporated into a portion of the refrigeration appliance 10 and configured to control the various operations of the system 20 as discussed herein. In particular, the controller 40 may be configured to control the activation, duty cycle, and operation of the compressor 28 and each of the valves 26, 44 and/or fans 50 discussed herein. Additionally, the controller 40 may be configured to monitor temperature indications communicated via temperature sensors 42 disposed in each of the compartments 12 (e.g. a first temperature sensor 42*a*, a second temperature sensor 42*b*, a third temperature sensor 42*c*). The temperature sensors 42 may correspond to a variety of temperature sensing devices including but not limited to thermistors, thermocouples, diode semiconductor sensors, etc. The controller 40 may comprise one or more logic control devices, integrated circuits, processors, and/or memory devices, which may be programmed with and/or configured to provide for the operation of the various control routines and methods of operation discussed herein.

In operation, the controller 40 may control the multi-directional outlet valve 26 to supply the thermal exchange media 24 directly to a multi-directional inlet valve 44, which may then be supplied to the freezer compartment evaporator 22*c*. Accordingly, a charged thermal exchange media 24 may be supplied from the multi-directional outlet valve 26 to the freezer compartment evaporator 22*c* bypassing the refrigerator evaporator 22*a* and/or the convertible compartment evaporator 22*b*. Additionally, a partially spent thermal exchange media 24 may be supplied to the freezer compartment evaporator 22*c* from the refrigerator evaporator 22*a* and/or the convertible compartment evaporator 22*b* via the multi-directional inlet valve 44 based on the control position of the multi-directional outlet valve 26. In this way, the system may provide for independent cooling of each of the compartments 12. Further detailed description of an appliance comprising multi-directional valves 26, 44 similar to those discussed herein is provided in U.S. Pat. No. 10,514,194, entitled, "MULTI-EVAPORATOR APPLIANCE HAVING A MULTI-DIRECTIONAL VALVE FOR DELIVERING REFRIGERANT TO THE EVAPORATORS", the disclosure of which is incorporated herein by reference in its entirety.

In various implementations of the system 20, a fan 50 is disposed proximate to each of the evaporators 22 such that heat energy in each of the compartments is distributed and effectively absorbed by the evaporators 22. In this way, the heat energy may be evenly distributed in each of the compartments 12 to provide for a consistent temperature and an improved cooling rate. More specifically, the refrigerator compartment 12*a* may comprise a first fan 50*a* disposed proximate to the first evaporator 22*a*, and the convertible compartment 12*b* may comprise a second fan 50*b* disposed proximate to the second evaporator 22*b*. Additionally, the freezer compartment 12*c* may comprise a third fan 50*c* disposed proximate to the third evaporator 22*c*. In this configuration, the controller 40 of the system may control the multi-directional valves 26 and 44 to control the path of the charged thermal exchange media 24 to each of the evaporators 22 to absorb heat energy in each of the corresponding compartments 12. Additionally, the controller 40 may be configured to activate the fans 50 to distribute the heat energy in response to the cooling of each of the compartments 12.

In some implementations, one or more of the compartments 12 may be equipped with a heating element 52 or heater, which may correspond to a resistive electric heating element. For example, a first heating element 52*a* (e.g. a defrost heating element) may be disposed in the freezer compartment 12*c* proximate to the third evaporator 22*c* and the third fan 50*c*. In this configuration, the controller 40 of the system may be configured to selectively activate the first heating element 52*a* to increase the temperature of the freezer compartment 12*c*. Such operation may be implemented in the system 20 to limit or prevent the build-up of frozen material in the freezer compartment 12*c* to achieve frost-free operation. In this configuration, the controller 40 may be configured to melt and drain frozen liquids from the freezer compartment 12*c*.

A second heating element 52*b* may further be incorporated in the convertible compartment 12*b*. Similar to the first heating element 52*a*, the second heating element 52*b* may also be activated by the controller 40 to provide for frost-free operation of the convertible compartment 12*b*. Each of the heating elements 52 may be positioned proximate to the fans 50 to distribute the heat energy in the corresponding compartment 12. Though discussed in reference to a single fan and heating element disposed in the compartments 12, a number of heaters and/or fans may be used in combination or distributed in the compartments 12. Accordingly, the system 20 may comprise heating elements 52 in one, two, or each of the compartments 12 to implement the temperature control routines and operations as discussed herein.

Still referring to FIGS. 1 and 2, the controller 40 of the refrigeration appliance 10 may be configured to adjust the temperature of one or more of the compartments 12 to provide for flexible or convertible temperature control operation. As later discussed in reference to FIGS. 3 and 4, the system 20 may be configured to rapidly adjust the temperature of the one or more of the compartments 12 by controlling one or more of the heating elements 52 and the fans 50 to increase a temperature of a selected compartment such that the operation of the compartment 12 may be adjusted based on a user input or setting. The user input may be received via a control panel or connected device (e.g. mobile phone, tablet, etc.), which may be in communication with the controller 40 via a wired or wireless interface as part of a smart or connected home system.

As previously discussed, the controller of the appliance 10 may be configured to control the temperature of the convertible compartment and rapidly adjust the temperature over a range of setpoints, which may vary from approximately −25° C. to 15° C. Such a temperature range may correspond to temperatures that may be implemented to store a variety of goods. However, other temperatures or ranges of temperatures may be implemented and achieved via the control routines and apparatuses described herein. Though such flexible temperature control may be implemented in one, two, or each of the compartments 12, the exemplary operations are discussed in reference to the convertible compartment 12*b* for clarity. Accordingly, the specific devices shown and described herein shall be considered to provide an informative and enabling description of the novel operations of the system and shall not be considered limiting to the scope of the disclosure.

In an exemplary implementation, the system 20 may provide for rapid heating of the convertible compartment 12*b* by controlling the second heating element 52*b*. The controller 40 may control the second heating element 52*b* in coordination with the multi-directional outlet valve 26 and the second fan 50*b*. More specifically, the controller 40 may be configured to increase the temperature of the convertible compartment 12*b* by selectively activating the second heating element 52*b* in coordination with the operation of the second fan 50*b* while controlling the multi-directional outlet valve 26 to suppress or stop the flow of charged thermal exchange media 24 through the second evaporator 22*b*. In this configuration, the controller 40 may be operable to increase and decrease the temperature of the convertible compartment 12*b* to rapidly achieve a variety of setpoint temperatures as identified and monitored via the second temperature sensor 42*b* disposed in the convertible compartment 12*b*. Though discussed in reference to the second fan 50*b* and the second heating element 52*b* being implemented to control the temperature, a plurality of fans and/or heating elements may be incorporated each of the compartments 12 in a variety of arrangements to suit the desired operating configuration.

Figure 3:
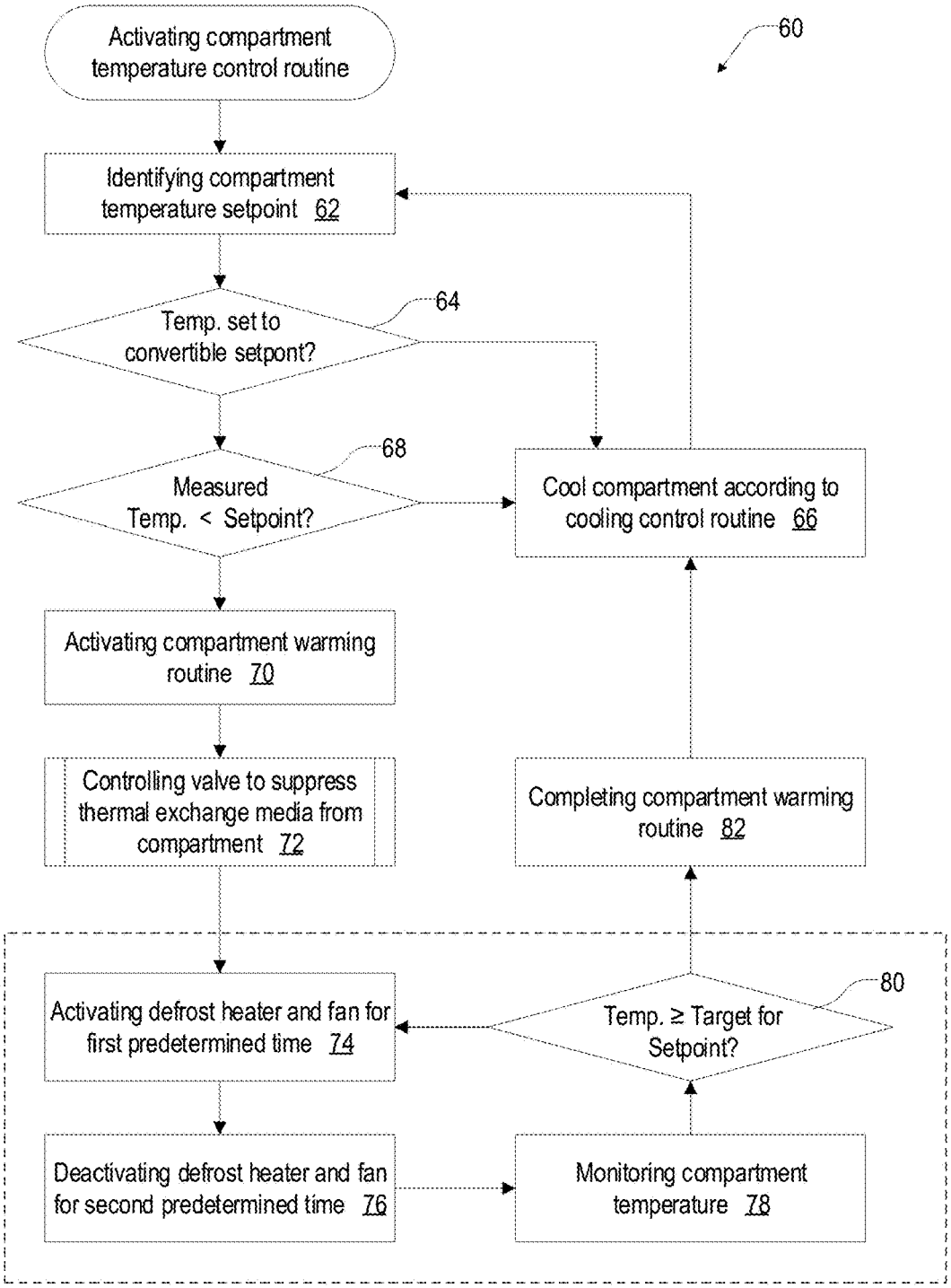
FIG. 3 is a flow chart demonstrating a method for controlling a heating routine of a refrigeration appliance.
Figure 4:
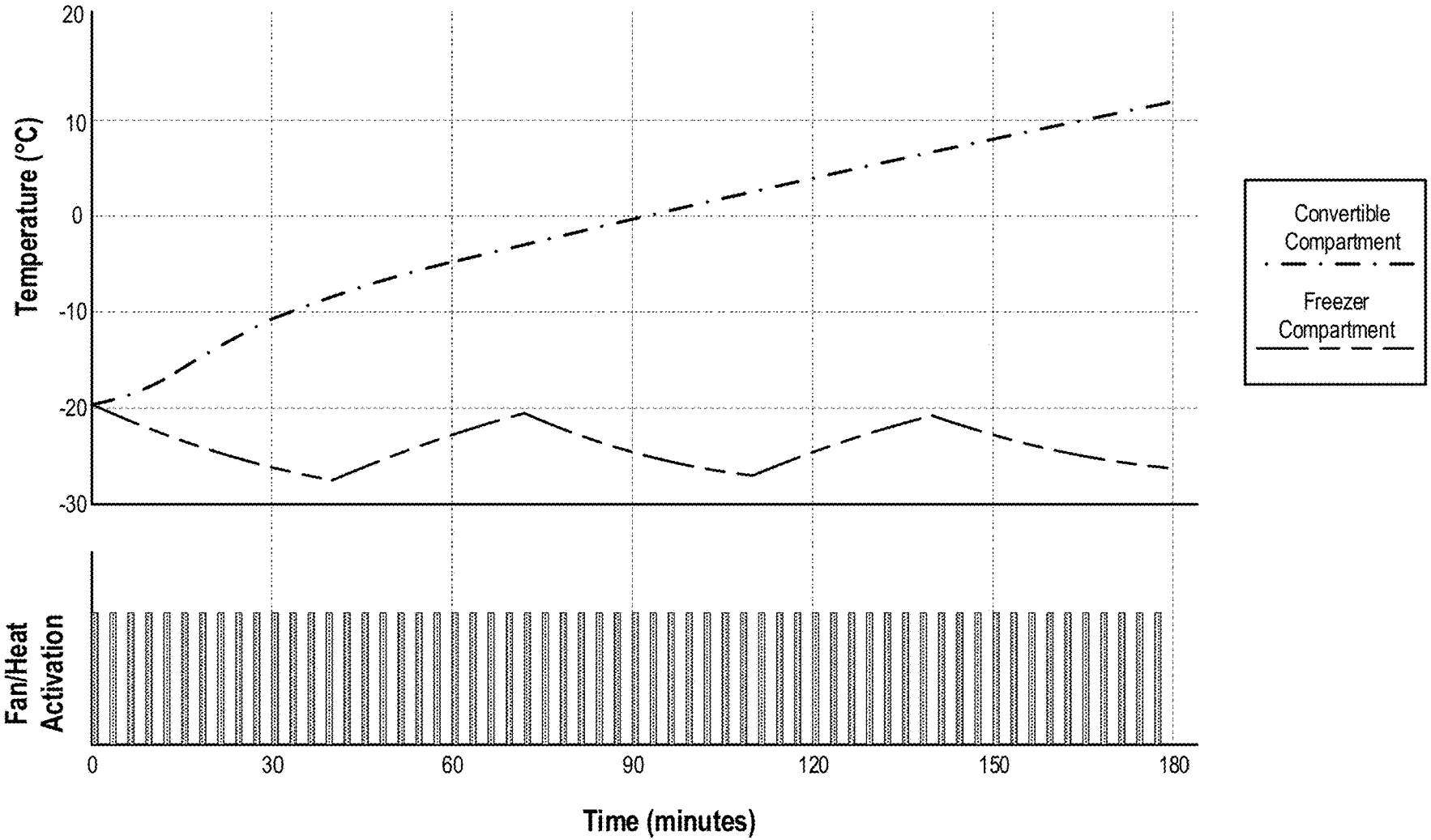
FIG. 4 is a graphical depiction of an activation interval of a heating element and a fan for a heating routine demonstrated in combination with a temperature of a convertible compartment and a freezer compartment over time in accordance with the disclosure.

As discussed in further detail in reference to FIGS. 3 and 4, the controller 40 may be configured to control the second heating element 52*b* in coordination with the operation of the second fan 50*b* to rapidly increase the temperature. In some implementations, the controller 40 may activate the second heating element 52*b* in coordination with the second fan 50*b* over a plurality of predetermined time intervals, which may correspond to alternating temporal periods of heating with circulation and periods where the second heating element 52*b* and/or the second fan 50*b* are inactive. In this way, the controller 40 of the appliance 10 may provide a specialized heating cycle for rapid heating of the convertible compartment 12*b*.

In order to control the temperature of the convertible compartment 12*b*, the controller 40 may be configured to monitor and control the temperature to achieve a plurality of predetermined setpoint temperatures, which may be set or identified by a user of the appliance 10. For example, the controller 40 may be configured to control the temperature of the convertible compartment 12*b* to a plurality of predetermined temperature setpoints (e.g. 0° C., 4° C., 10° C.). In response to an input adjusting the temperature of the convertible compartment 12*b*, the controller 40 may compare a setpoint temperature of the convertible compartment 12*b* to a measured temperature identified by the second temperature sensor 42*b*. In response to the temperature of the convertible compartment 12*b* less than a selected setpoint, the controller 40 may activate the second heating element 52*b* and the fan 50*b* for alternating intervals of on-periods (e.g. 1 minute) over a first predetermined time followed by off-periods over a second predetermined time (e.g. 2 minutes). Following each interval, the controller 40 may compare the temperature in the convertible compartment 12*b* with a target temperature (e.g. 2.5° C., 6.5° C., 12.5° C.), which may be associated with each of the temperature setpoints. Based on the comparison of the target temperature to the measured temperature identified by the second temperature sensor 42*b*, the controller 40 may either initiate an additional heating cycle or conclude the heating routine.

Though discussed in reference to the specific setpoints and target temperatures, the system 20 may comprise almost any number of predetermined temperature setpoints and corresponding target temperatures based on a desired accuracy or resolution of temperature settings for the system 20. In general, the target temperatures may be greater than the temperature setpoints by an offset temperature. The offset temperature discussed herein may be approximately 2.5° C. but may vary based on the geometry and residual cooling properties of the convertible compartment 12*b*. As may be understood by those skilled in the art, the residual cooling of the convertible compartment 12*b* may be related to the proportions of an interior surface area of the convertible compartment 12*b*, the material properties of the enclosure forming the convertible compartment 12*b*, the mass of the food products stored in the convertible compartment 12*b*, and additional properties that may affect the dissipation or absorption of heat therein. Accordingly, the offset temperature may vary based on the specific application of the temperature control routine and a capacity of the compartment in which the control routine is applied.

For clarity, an example of a number of temperature setpoints and corresponding target temperatures is shown in Table 1 and may be referred to in reference to the exemplary operation of the system 20 as discussed in reference to FIGS. 3 and 4.

TABLE 1

| Sample temperature setpoints and target temperature for heating routine | | | |
|---|---|---|---|
| | Setpoint | | |
| | A | B | C |
| Setpoint Temperature (° C.) | 0 | 4 | 10 |
| Target Temperature (° C.) | 2.5 | 6.5 | 12.5 |

Accordingly, for each of the setpoints, the controller 40 may monitor the temperature identified by the second temperature sensor 42*b* to determine if the measured temperature is greater than or equal to the target temperature for the setpoint (e.g. Setpoint A, Setpoint B, Setpoint C, etc.). In this way, the controller 40 may be configured to activate the cycles of alternating heating intervals and idle intervals of the second heating element 52*b* and/or the second fan 50*b*. In general, a first duration of the heating intervals (e.g. on-periods) may be less than a second duration of the idle intervals (e.g. off-periods) of the second heating element 52*b*. In some instances, the second duration of the idle intervals may be 1.5, 2, 2.5, or even 3 times longer than the first duration of the heating intervals. In the specific examples discussed herein, the second duration of the idle intervals is twice as long as the first duration of the heating intervals.

In general, the predetermined time periods for the on-periods and off-periods may correspond to periods wherein the second heating element 52*b* is supplied with current followed by idle periods wherein the current flow is disconnected or otherwise suppressed by the controller 40 (e.g. via a switching circuit). These time periods may be co-extensive with the activation periods of the second fan 50*b* but may also be applied independently or over different time intervals from the operation of the second fan 50*b*. For example, the controller 40 may control the second fan 50*b* to continue to operate over all or part of the off-periods of the second heating element 52*b*. In a particular example, the controller 40 may be configured to maintain the activation of the second fan 50*b* over a third predetermined time period following the deactivation of the second heating element 52*b* by the controller 40. The third predetermined time period may be less than the second predetermined time period such that the fan is deactivated for a portion of the second predetermined time period. For clarity, the heating routine and results shown in FIGS. 3 and 4 will be discussed in reference to the concurrent activation and deactivation of the second heating element 52*b* in coordination with the activation and deactivation of the second fan 50*b*.

Referring now to FIGS. 3 and 4, a method 60 for a heating routine for the convertible compartment 12*b* is discussed in reference to sample heating results demonstrating the temperature change of the freezer compartment 12*c* and the convertible compartment 12*b*. In operation, the method 60 may be initiated by the controller 40 in response to an input or adjustment of one or temperature settings of the convertible compartment 12*b*. In response to the input or adjustment, the controller 40 may proceed with the method 60 by identifying the temperature of the convertible compartment 12*b* via the second temperature sensor 42*b* (62). Based on the temperature, the controller 40 may first determine if the temperature of the convertible compartment is set to a setpoint (e.g. A, B, C, etc.) associated with user interface or a temperature control status identified by the controller 40 (64). If the temperature of the convertible compartment 12*b* is greater than or equal to the setpoint, the controller 40 may proceed by controlling the system 20 to cool the convertible compartment 12*b* (66). If the temperature of the convertible compartment 12*b* is less than the setpoint (68), the controller 40 may be configured to activate a heating routine (70). The heating routine may be configured to rapidly adjust the temperature of the convertible compartment 12*b* to a target temperature associated with the setpoint.

In response to the activation of the heating routine, the controller 40 may control the multi-directional outlet valve 26 to suppress or stop the thermal exchange media 24 from being delivered to the second evaporator 22*b* (72). Additionally, the controller 40 may control the second fan 50*b* and the second heating element 52*b* to activate to heat the convertible compartment 12*b* according to an alternating sequence of heating intervals followed by idle or non-heating intervals of the second heating element 52*b*. As demonstrated in FIG. 4 an example of measured results for the temperature of the convertible compartment 12*b* and the freezer compartment 12*c* are shown in relation to time. Additionally, the temperatures are shown in relation to the timing of the activation intervals of the second fan 50*b* and the second heating element 52*b*. Accordingly, FIG. 4 may provide a visual representation of the control of the second fan 50*b* and the second heating element 52*b* and the resulting temperature change in the convertible compartment 12*b* as a result of the operations discussed in the warming routine.

Referring still to FIGS. 3 and 4, in response to the temperature of the convertible compartment 12*b* detected to be less than the selected setpoint, the controller 40 may activate the second heating element 52*b* and the fan 50*b* for alternating intervals of on-periods (e.g. 1 minute) over a first predetermined time (74) followed by off-periods (e.g. 2 minutes) over a second predetermined time (76). As depicted in FIG. 4, the resulting temperatures for the controller 40 heating the convertible compartment 12*b* to Setpoint C or 10° C. are shown. Following each of the heating and/or idle intervals, the controller 40 may monitor the temperature of the convertible compartment 12*b* (78). The controller 40 may then compare the temperature in the convertible compartment 12*b* with a target temperature (e.g. 2.5° C., 6.5° C., 12.5° C.), which may be associated with each of the temperature setpoints (80). Based on the comparison of the target temperature to the measured temperature as identified by the second temperature sensor 42*b*, the controller 40 may either initiate an additional heating cycle by returning to step 74 or conclude the heating routine by continuing to step 82.

As depicted in FIG. 4, in response to the heating routine, the temperature of the convertible compartment 12*b* may gradually increase until the target temperature (e.g. 12.5° C.) for the corresponding setpoint (e.g. Setpoint C) is reached. From the results, the system 20 is operable to increase the temperature of the convertible compartment 12*b* from approximately negative 20° C. to 12° C. over a period of 180 minutes or 3 hours. Over the same time, the controller 40 is configured to control the multi-directional valves 26 and 44 to control the path of the charged thermal exchange media 24 to maintain the temperature of the freezer compartment 12*c*. From the results, the cooling phases or intervals of the third evaporator 22*c* for the freezer compartment 12*c* are demonstrated by decreasing temperature periods and idle periods of the third evaporator 22*c* are demonstrated by increasing temperature periods. Over the same time, the results demonstrate that the heating routine is operable to steadily increase the temperature of the convertible compartment 12*b* until the target temperature is reached. In this way, the disclosure may provide for an efficient, rapid, and accurate control routine to rapidly control and adjust the temperature of the convertible compartment 12*b*.

It will be understood by one having ordinary skill in the art that construction of the described device and other components is not limited to any specific material. Other exemplary embodiments of the device disclosed herein may be formed from a wide variety of materials unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerating appliance comprising:

a plurality of storage compartments comprising a first compartment comprising a first evaporator configured to absorb heat energy;

a first heating element disposed in a first compartment; and a temperature sensor disposed in the first compartment and configured to identify a temperature signal;

a controller configured to:

control a cooling routine for the first compartment, wherein the controller controls a flow of a thermal exchange media to the first evaporator;

receive an indication of a temperature setting comprising a setpoint;

identify a temperature of the first compartment in response to the temperature signal;

control a heating routine in response to the setpoint being greater than the temperature of the first compartment, wherein the heating routine comprises:

a first interval wherein the controller is configured to activate the first heating element; and a second interval wherein the controller is configured to deactivate the first heating element, wherein the first interval and the second interval are predetermined time intervals independent of a change in the temperature and the controller is configured to alternate between the first interval and the second interval until the temperature of the first compartment is greater than or equal to a target temperature associated with the setpoint, wherein the alternating time periods of the first interval and the second interval are alternated a plurality of times over a 10 minute period.

2. The refrigeration appliance according to claim 1, further comprising:

a fan disposed in the first compartment.

3. The refrigeration appliance according to claim 2, wherein the controller is configured to control the fan in coordination with the first interval thereby activating the first heating element and the fan during overlapping temporal periods.

4. The refrigeration appliance according to claim 1, wherein the target temperature is greater than the setpoint.

5. The refrigeration appliance according to claim 1, wherein a first time of the first interval is less than a second time of the second interval.

6. The refrigeration appliance according to claim 5, wherein the first time is at least 20% shorter than the second time.

7. The refrigeration appliance according to claim 5, wherein the first time is at least 40% shorter than the second time.

8. The refrigeration appliance according to claim 1, wherein the controller is further configured to:

control the temperature of the first compartment to a plurality of setpoints defining predetermined temperatures of the first compartment.

9. The refrigeration appliance according to claim 8, wherein the controller is configured to control the heating routine to heat the first compartment to a target temperature associated with each of the plurality of setpoints, wherein each of the target temperatures is greater than a corresponding one of the setpoints.

10. The refrigeration appliance according to claim 1, wherein the first compartment is a convertible compartment configured to be controlled to maintain the temperature between at least 10° C. below a freezing point and at least 5° C. above the freezing point.

11. The refrigeration appliance according to claim 10, wherein the convertible compartment is adjacent to a second compartment comprising a freezer compartment.

12. The refrigeration appliance according to claim 1, further comprising at least one multi-directional valve configured to selectively suppress the flow of a thermal exchange media to each of the first evaporator and the second evaporator, wherein the controller is further configured to:

selectively control the flow of the thermal exchange media to the first evaporator and the second evaporator via the at least one multi-directional valve.

13. The refrigeration appliance according to claim 1, wherein the first interval is shorter than the second interval.

14. The refrigeration appliance according to claim 1, wherein the second interval is at least twice as long as the first interval.

15. A method for controlling an operation of a refrigeration appliance, the method comprising:

controlling a first cooling routine for a first compartment via a flow of a thermal exchange media to a first evaporator;

receiving an indication of a temperature setting comprising a setpoint;

identifying a temperature of the first compartment in response to a temperature signal;

control a heating routine in response to the setpoint being greater than the temperature of the first compartment, wherein the heating routine comprises:

activating a heating element and a fan in the first compartment over a first interval;

deactivating the heating element and the fan over a second interval;

activating the first interval and the second interval over predetermined alternating time periods, wherein the first interval extends for a first duration and the second interval extends for a second duration, wherein the first duration is less than the second duration; and in response to the temperature of the first compartment being greater than or equal to a target temperature associated with the setpoint, returning to the cooling routine.

16. The method according to claim 15, wherein the target temperature is greater than the setpoint.

17. The method according to claim 15, wherein a first time of the first interval is less than a second time of the second interval.

18. The method according to claim 15, further comprising:

contemporaneous to the heating routine of the first compartment, controlling a second cooling routine for a second compartment via a flow of a thermal exchange media to a second evaporator.

19. The method according to claim 15, wherein the first interval and the second interval alternate ten times over a 30 minute time period.

20. A refrigerating appliance comprising:

a plurality of storage compartments comprising:

a convertible compartment comprising a first heating element, a first evaporator, and a first fan disposed therein; and a freezer compartment adjacent to the convertible compartment, the freezer compartment comprising a second heating element, a second evaporator, and a second fan disposed therein; and at least one temperature sensor disposed in the convertible compartment and configured to identify a temperature signal;

a controller configured to:

control a cooling routine for the first compartment and the second compartment, wherein the controller selectively controls a flow of a thermal exchange media to the first evaporator and the second evaporator to process the cooling routines;

receive an indication of a temperature setting comprising a setpoint of the convertible compartment;

identify a temperature of the convertible compartment in response to the temperature signal;

control a heating routine in response to the setpoint being greater than the temperature of the convertible compartment, wherein the heating routine comprises:

a first interval wherein the controller is configured to activate the first heating element and the first fan for a first duration; and a second interval wherein the controller is configured to deactivate the first heating element and the first fan for a second duration greater than the first duration, wherein the controller is configured to activate the first interval and the second interval over predetermined alternating time periods until the temperature of the convertible compartment is greater than or equal to a target temperature associated with the setpoint.

* * * * *